United States Patent [19]

Lundquist et al.

[11] Patent Number: 5,038,494

[45] Date of Patent: Aug. 13, 1991

[54] APPARATUS AND METHOD FOR DRYING AND RESTORING WET BOOKS

[75] Inventors: Eric G. Lundquist, Hillsborough; Robert S. Ritchie, Valencia, both of Calif.

[73] Assignee: Document Reprocessors, San Francisco, Calif.

[21] Appl. No.: 335,367

[22] Filed: Apr. 10, 1989

[51] Int. Cl.[5] ..... F26B 5/04

[52] U.S. Cl. ..... 34/16; 34/17; 34/60; 34/92

[58] Field of Search ..... 34/145, 146, 15, 5, 34/92, 60, 16, 17

[56] References Cited

U.S. PATENT DOCUMENTS 1,726,373 8/1929 Voightlander ..... 34/145 X 3,199,221 8/1965 Mehrlich et al. ..... 34/145

*Primary Examiner*—Henry A. Bennet

*Attorney, Agent, or Firm*—Shoemaker and Mattare, Ltd.

[57] ABSTRACT

This invention relates to an apparatus and method for drying and/or restoring books and other materials which have been wet, wherein the wet and/or distorted materials are placed in a vacuum chamber and subjected to vacuum while being gradually and uniformly heated through the use of heat conductive supports. A compressive force is applied to the materials while they are being heated to straighten and restore the distorted materials.

20 Claims, 7 Drawing Sheets

APPARATUS AND METHOD FOR DRYING AND RESTORING WET BOOKS

FIELD OF THE INVENTION

This invention relates to the drying and restoration of wet books and other documents made from paper products. More specifically, the present invention relates to an apparatus and method for drying and/or restoring wet books, pamphlets, and other bound and unbound materials.

DESCRIPTION OF THE PRIOR ART

Paper products such as books, pamphlets and other bound or unbound materials are particularly susceptible to fire and/or water damage. Fire damage, of course, generally results in the destruction of the book or document. Water damage, on the other hand, may render the book or document or the like unsuitable for use, but generally does not result in total destruction of the object. There is also a relatively higher likelihood of water damage to books and the like, either because of the operation of a sprinkler system, the occurrence of a flood, burst pipes or other event. Accordingly, in order to place such water-damaged objects in condition to make them suitable for use, various drying techniques have been devised in the prior art.

Two methods have been primarily used in the prior art to dry water-damaged books and the like. In both methods the water soaked materials are placed in a chamber and subjected to vacuum or freeze drying (sublimination during the drying cycle) and require a 10–15 day drying cycle for heavily water soaked materials. One method involves the use of refrigeration cold traps or coils, in which water vapor is condensed on cooling coils and removed either by defrosting or condensing; and another method subjects the books to repeated cycles of elevated temperature, low humidity air or high temperature inert gas, such as dry nitrogen, wherein the moist atmosphere is cycled through dehumidifiers and recycled back into the chamber to absorb moisture.

One problem which occurs with books and other similar materials which have been water soaked is that the pages become distorted. This problem is especially acute with books, which, due to the unsymmetrical binding and board coverings have a natural affinity for distortion when wet. Neither of the prior art processes have any provision for restoring the distorted materials to at or near their original condition. In fact, the problem of distortion may even be exacerbated by the application of air drying or drying by other techniques, particularly the high temperature cycling used by one prior art method. Applicant is not aware of any prior art method or apparatus for restoring such distorted materials to an undistorted condition, whether they have been previously dried or not.

SUMMARY OF THE INVENTION

Accordingly, it is an object of this invention to provide an apparatus and method for drying books, pamphlets, and other bound and unbound materials, wherein the drying is accomplished more quickly than with prior art methods and apparatus.

Another object of the invention is to provide a method and apparatus for drying books, pamphlets and other bound and unbound materials, wherein the materials are restored to an undistorted condition during the drying process.

A further object of the invention is to provide a method and apparatus for restoring books, pamphlets and other bound and unbound materials which have been water soaked.

These objects are accomplished by a simple and effective apparatus and method, in which the wet materials are placed in shallow trays made of thermally conductive material, with separator plates of like or similar thermally conductive material inserted between selected numbers of pages of the material. Pressure applying means is then associated with the thus arranged materials to exert a compressive force on the materials in a direction perpendicular to the plane of the pages. These packages or trays of compressed materials are then placed on heated shelves which apply a substantially uniform low temperature to the thermally conductive trays and separator plates, and thus to the wetted materials. The entire assembly is then placed in a vacuum chamber for application of a vacuum to the materials to enhance removal of moisture therefrom. The water vapor partial pressure differential between the wet materials and the vacuum environment causes the water vapor to exit the materials and form a "fog" inside the chamber. This water vapor or "fog" is then extracted from the chamber via a vacuum pump.

It has been discovered by applicant that when the materials are permitted to reach equilibrium just above the freezing temperature, the materials "anneal" and, under the compressive force being exerted thereon, return to their original condition much more efficiently and in a shorter period of time than would otherwise be accomplished, thus reducing internal stresses on the materials during the drying and restoration process.

The heat and chamber pressure can be regulated to either maintain vacuum drying (above freezing) or freeze drying (below freezing) temperature in the materials. In either case, the addition of heat to the material accelerates the drying process. Best results have been obtained by maintaining the pressure above the triple point (freezing) of water with maximum heat of the materials maintained below 120° F. This results in the shortest drying cycle time with a concommitant maximum time to permit restoration of distorted material. A key feature of the invention is the gradual and uniform application of heat by conductivity such that the materials do not exceed 120° F. at any time during the cycle.

The invention is equally suitable for drying and restoring either large or small quantities of materials. For example, 10–15 books per day could be treated in accordance with the invention, or 10,000 books per day could be treated. The process is the same in either event.

BRIEF DESCRIPTION OF THE DRAWINGS

The foregoing as well as other objects and advantages of the invention will become apparent from the following detailed description when considered with the accompanying drawings, in which like reference characters designate like parts throughout the several views, and wherein:

FIG. 24 is a schematic view of a variation in which the vacuum chamber is formed in a mobile unit, such as a truck or the like.

DETAILED DESCRIPTION OF THE PREFERRED EMBODIMENTS

Figure 1:
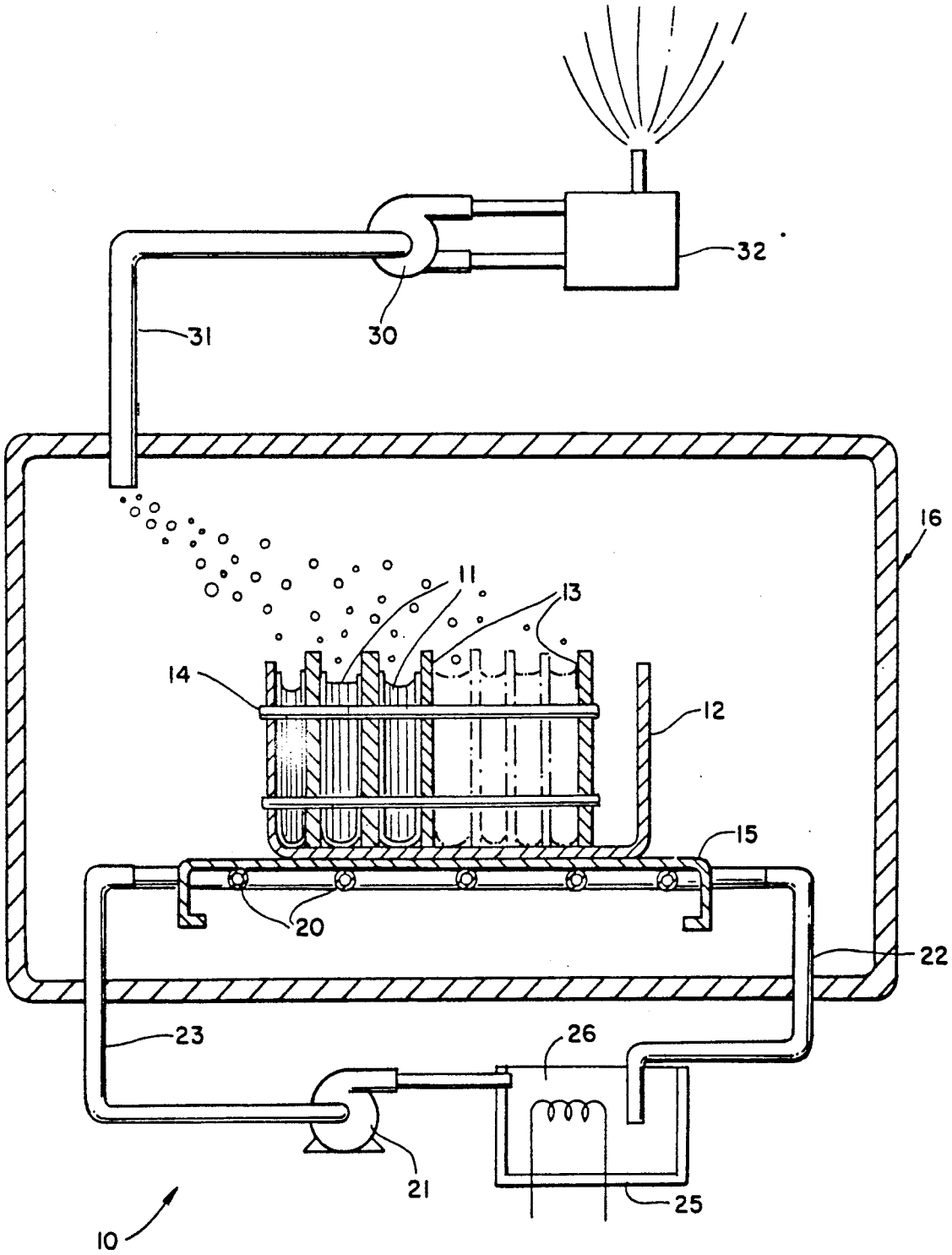
FIG. 1 is a schematic view of a system for practising the method of the invention.

Referring more specifically to the drawings, a first form of apparatus in accordance with the invention is represented schematically at 10 in FIG. 1. In this form of the invention a plurality of water soaked materials, such as books 11, are placed spine down on a thermally conductive tray 12, with separator plates 13 of thermally conductive material placed in alternating relationship with the books. The tray and separator plates conduct thermal energy to the books, and preferably are made of a highly thermally conductive material such as aluminum. This material not only has good thermal conductivity, but also is rigid, lightweight, and resists surface oxidation.

Compression means, such as elastic cords 14, are placed around the assembled books and separator plates to apply a substantially constant compressive force in a direction perpendicular to the plane of the pages of the books. Thus, as the books dry, shrinkage occurs (approximately 10–20%) and the constant force applied thereto gradually straightens the materials. The thus-assembled tray, books and separator plates are placed on a heated shelf 15 in a vacuum chamber 16, and a vacuum is applied to the chamber to promote evaporation of moisture from the books and to remove the water vapor from the chamber. The shelves, trays, plates and books eventually reach an equilibrium temperature, depending upon the degree of dryness of the books. Generally, even at very low residual humidity in the books (0–4%), there is a constant temperature differential between the water and the books or other materials.

Figure 15:
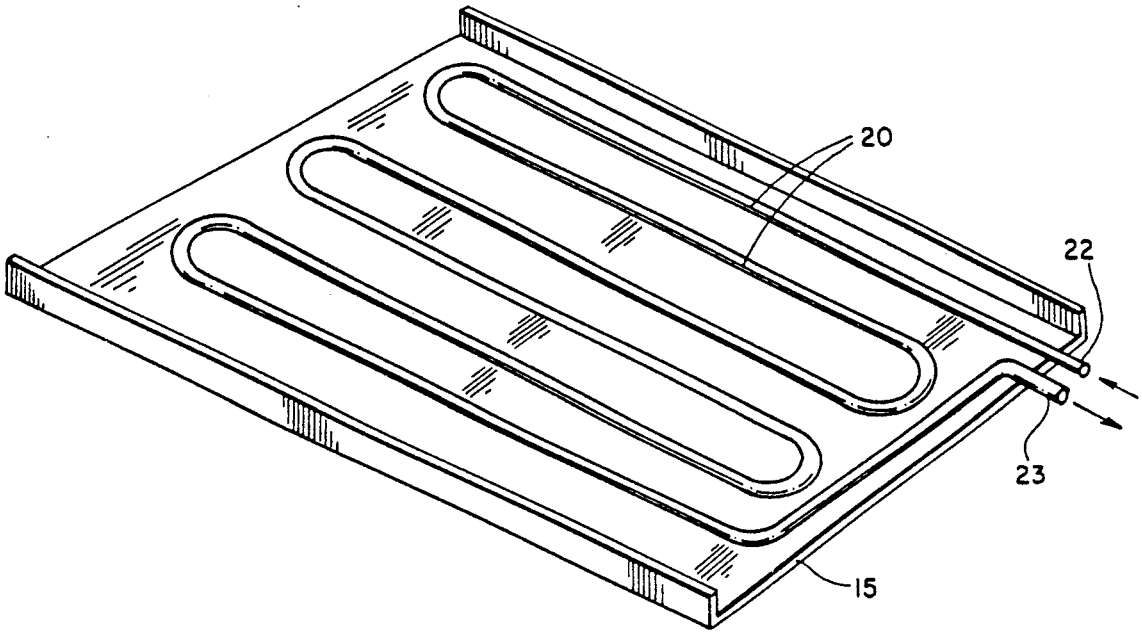
FIG. 15 is a bottom perspective view of a heated shelf or platform on which the tray assemblies may be supported while in the vacuum chamber for drying and restoration.

The shelf may be heated in a variety of ways, including the use of circulating hot water or other fluid, caused to flow through a serpentine conduit arrangement 20 (see FIG. 15) by suitable pump means 21 connected to an inlet 22 and outlet 23 leading to and from, respectively, the conduit 20. The heat exchange fluid is heated by a heat source 25 associated with a fluid reservoir 26 located outside the vacuum chamber. Whatever method of heating is applied to the shelves, it is preferred that the temperature be substantially uniform over the shelf area, and that it be carefully maintained below about 120° F. to avoid excessive heating of the materials. This heat is conducted through the shelf, tray and separator plates into the wet materials. Use of the separator plates between adjacent books, and even between the pages of larger books, insures that an elevated temperature is applied to essentially all of the wet materials. Use of circulating water at a controlled temperature through the conduit 20 provides maximum temperature regulation without danger of overheating the materials. This mode of heating also enables the gradual and uniform application of heat to the materials by conductivity, such that the temperature of the materials does not exceed approximately 120° F. at any time during the drying/restoration cycle.

Regulation of the pressure in the vacuum chamber is accomplished with a vacuum pump 30 connected to the chamber through a conduit 31. The vacuum pump may be of any suitable type, but in a particular embodiment comprises a liquid ring vacuum pump which operates to extract the water vapor from the chamber and mix it with the recirculating oil medium of the pump. This mixture is passed through a separator tank 32, at a temperature in excess of 212° F., whereby the water vapor is driven off as steam. The oil is then recycled through the vacuum pump system. Various other control devices, not shown, may be used to provide pressure and temperature control.

Figure 2:
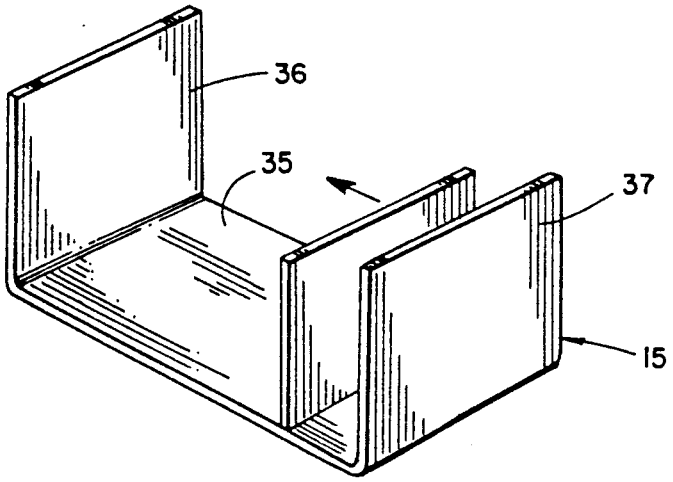
FIG. 2 is a top perspective view of one form of thermally conductive tray and separator plate which may be used in the invention.
Figure 3:
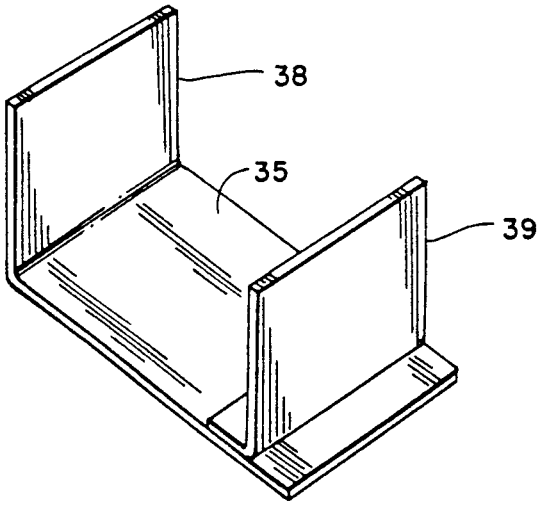
FIG. 3 is a top perspective view of another form of tray construction.
Figure 4:
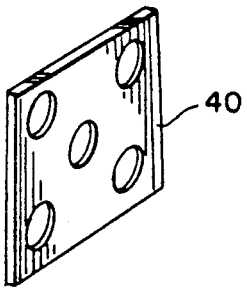
FIGS. 4, 5 and 6 are perspective views of some possible variations in the structure of the separator plates and/or tray end plates.
Figure 5:
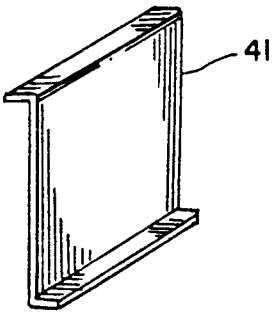
Figure 6:
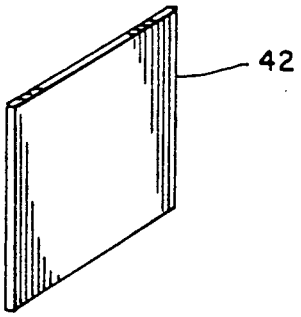
Figure 9:
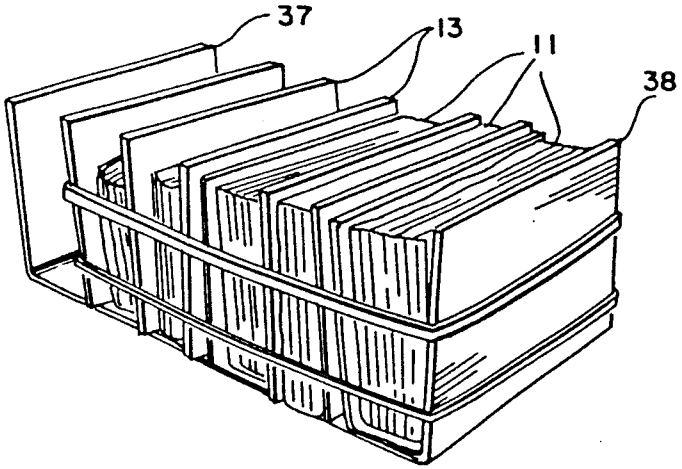
FIG. 9 is a perspective view of a plurality of books assembled with separator plates in a tray, as they might appear after having been dried and restored.

The trays may have a variety of shapes, but preferably are essentially U-shaped, with a bottom wall 35 and opposed fixed end walls 36 and 37 at opposite ends, as shown in FIG. 2, or one fixed end wall 38 and one movable end wall 39, as shown in FIG. 3. The trays may also be of any desireable size, although a tray assembly 17–19 inches long will accommodate 10–15 books and can easily be handled by one person. Further, the tray itself, and/or the separator plates may be perforated, as shown at 40 in FIG. 4, for better or more efficient evaporation of moisture from the wet materials; or the end walls and/or plates may have stiffened edges as shown at 41 in FIG. 5; or the plates may be plain rectangular plates as shown at 42 in FIG. 6. Additionally, aluminum alloys having a thickness between 0.090 and 0.125 inches have been found to be particularly suitable for the trays and plates.

Figure 8:
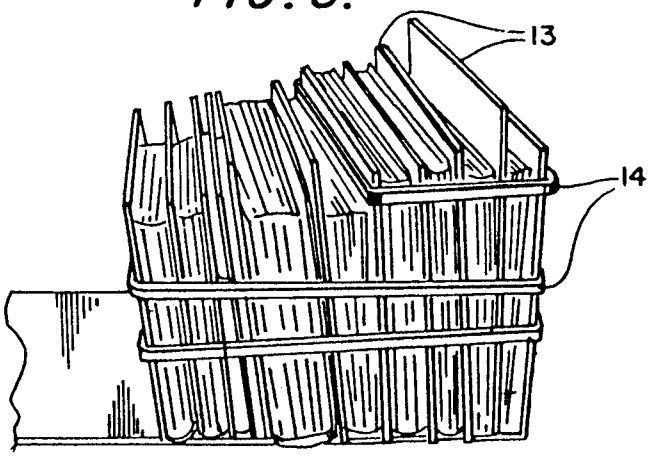
FIG. 8 is an isometric view of the materials of FIG. 7, with compression means applied to the components.
Figure 7:
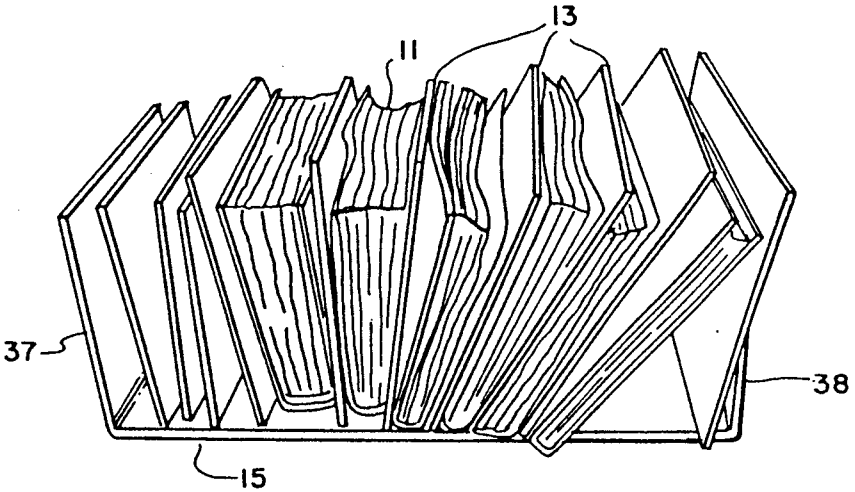
FIG. 7 is an isometric view of a plurality of wet materials, such as books, placed in alternating relationship with a plurality of separator plates on a thermally conductive tray.

As shown in FIG. 8, the assembly of books, tray and separator plates need not comprise uniformly sized books or other materials. For instance, as shown in this figure, some of the books may be substantially thicker than others, with separator plates preferably placed between the pages of the book, and other books may have a greater width or height dimension, with one or more additional flexible cords placed around these differently sized books to exert pressure uniformly over the entire width of the book.

Figure 10:
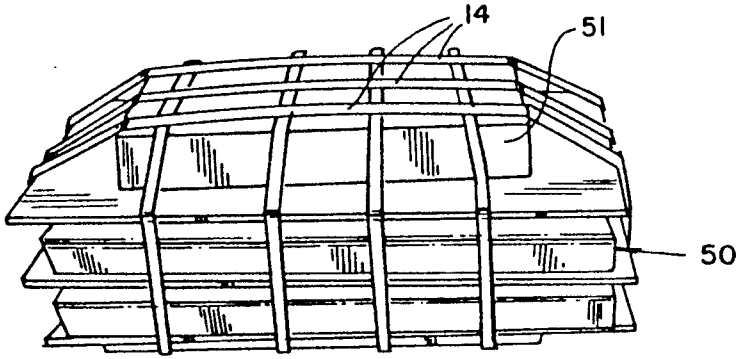
FIG. 10 is an isometric view of a pair of books assembled with a plurality of plates and then wrapped with compression means and spacers to form an assembly for drying small quantities of materials.

In some instances involving small numbers of books, as shown at 50 in FIG. 10, it may be desireable to simply use a plurality of separator plates in alternating relationship with one, two or more books, and to wrap the assembly with elastic cords and spacers 51, rather than using the tray.

Figure 11:
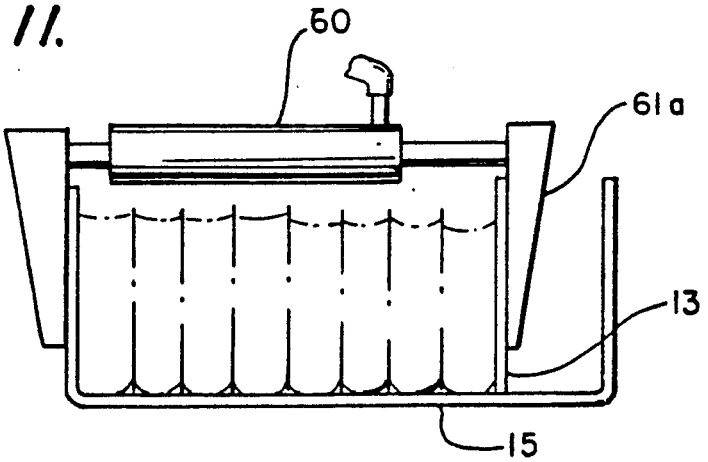
FIGS. 11, 12, 13 and 14 are schematic views in side elevation of various types of compression means which may be applied to the wet materials and separator plates assembled on a tray.
Figure 12:
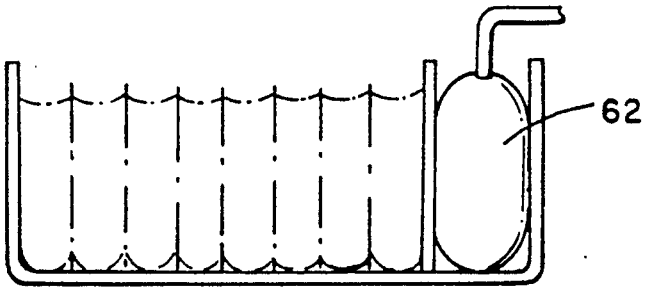
Figure 13:
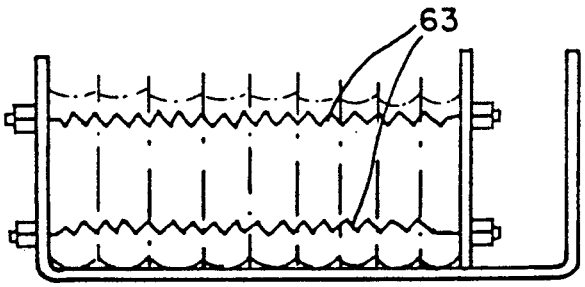
Figure 14:
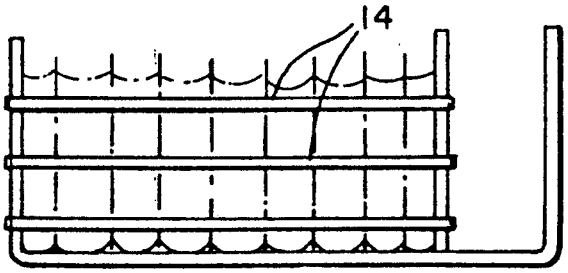

Various types of compression means may be used, as shown in FIGS. 11–14. In FIG. 11, for example, the compression means comprises a hydraulic or pneumatic press or ram 60 having one part 61 engaged against an end wall of the tray, and another arm or part 61*a* engaged against a movable plate positioned against the stack of books and plates mounted on the tray. The pressure on the ram is maintained substantially constant as the books shrink during the drying process. An alternate arrangement is shown in FIG. 12, wherein an inflated bladder 62 is engaged between an end wall of the tray and a movable plate adjacent the stack of books. As the pressure in the chamber drops, the bladder expands, maintaining a pressure on the books to straighten them during the drying process. In FIG. 13, one or more springs 63 are used to exert the compressive force on the books, and in FIG. 14 the preferred apparatus comprises the elastic cords previously described. The cords are easier to place and provide greater flexibility in positioning, adaptability to different book sizes and degree of compression. For instance, the cords enable use of plates and books without a tray, as shown in FIG. 10, and can be used in different multiples, depending upon the initial distortion of the materials. The elastic cords also exhibit almost constant force throughout the range of movement.

Figure 16:
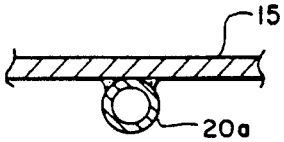
FIGS. 16, 17, 18, 19, 20 and 21 are fragmentary sectional views showing various types of heating element means which may be used in association with the shelf of FIG. 15.
Figure 19:
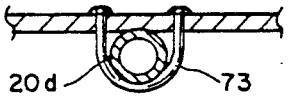
Figure 17:
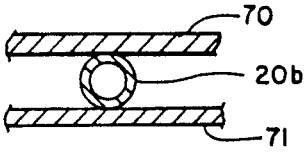
Figure 20:
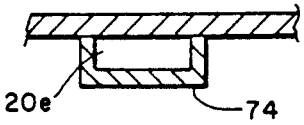
Figure 18:
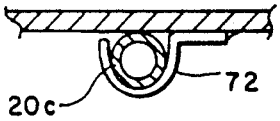
Figure 21:
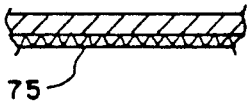

The conduit or tubing 20 for distributing heat over the area of the shelf may comprise any one of several different forms, as shown in FIGS. 16–21, for example. In FIG. 16, separate tubing 20*a* is welded to the underside of the shelf. In FIG. 17, tubing 20*b* is held captive between two spaced plates 70 and 71, making up the shelf. A plurality of brackets 72 welded to the underside of the plate support the tubing 20*c* in FIG. 18, and U-shaped brackets 73 extended through the shelf support the tubing 20*d* in FIG. 19. In FIG. 20, the conduit 20*e* is formed by an extruded channel 74 welded to the underside of the shelf. As shown in FIG. 21, electrical resistance heating means 75 supported on the underside of the shelf may be used instead of the circulating fluid systems described previously.

Figure 22:
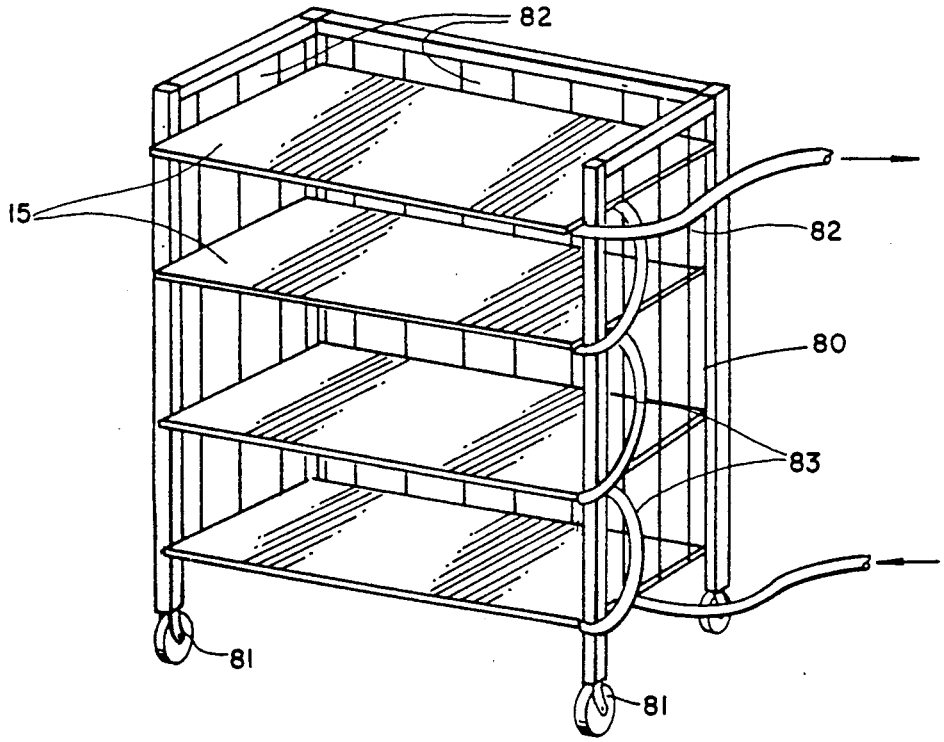
FIG. 22 is a perspective view of a movable cart having a plurality of heating platforms or shelves on which the tray assemblies may be placed.

As shown in FIG. 22, one or more shelves 15 may be incorporated in a movable cart 80 having casters or wheels 81 so that the cart may be moved about. In addition, the cart preferably has open or wire mesh sides 82 for thorough circulation of air around the books or other materials. Conduits 83 interconnect the tubing under the respective shelves for circulation of heated fluid. When a cart has been loaded with books or other materials to be dried and/or restored, it may be easily moved into a vacuum chamber and hooked up with a source of heated fluid. If necessary or desired, a fork lift or other piece of equipment may be used to transfer the loaded cart.

Figure 23:
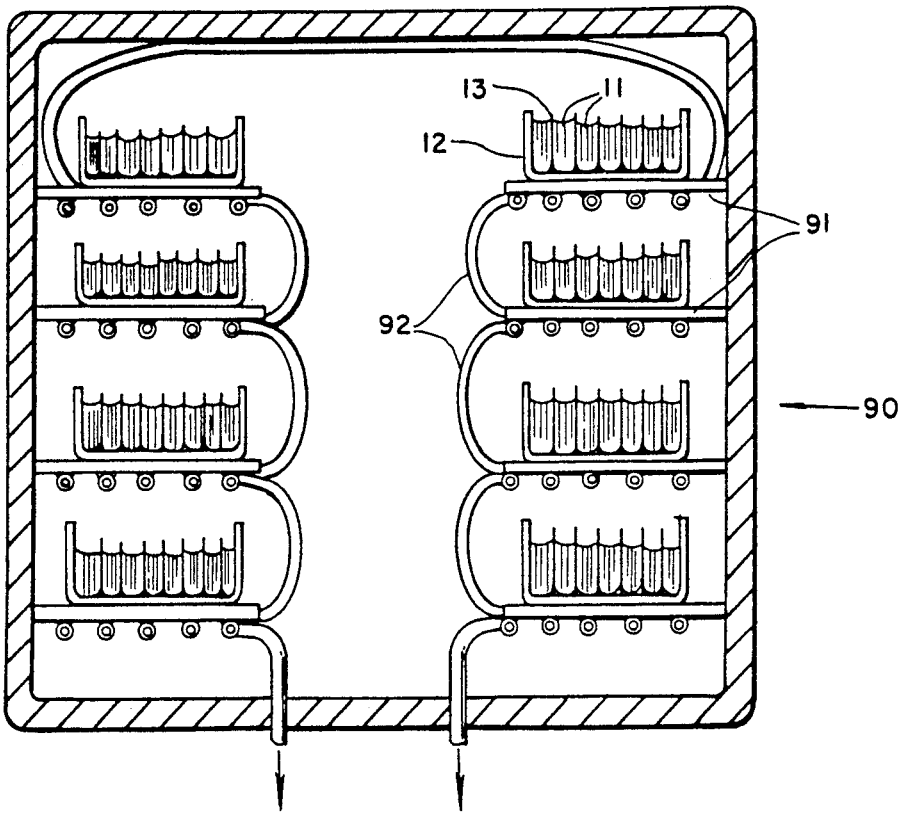
FIG. 23 is a schematic view of one possible arrangement of heated support shelves and tray assemblies in a vacuum chamber.

An alternate arrangement is shown at 90 in FIG. 23. In this form of the invention, the heated shelves 91 are built into the vacuum chamber and interconnected by conduits 92 for circulation of heated fluid. Trays 12 containing alternating books 11 and separator plates 13 are placed on the shelves for drying and/or restoration of the books.

Figure 24:
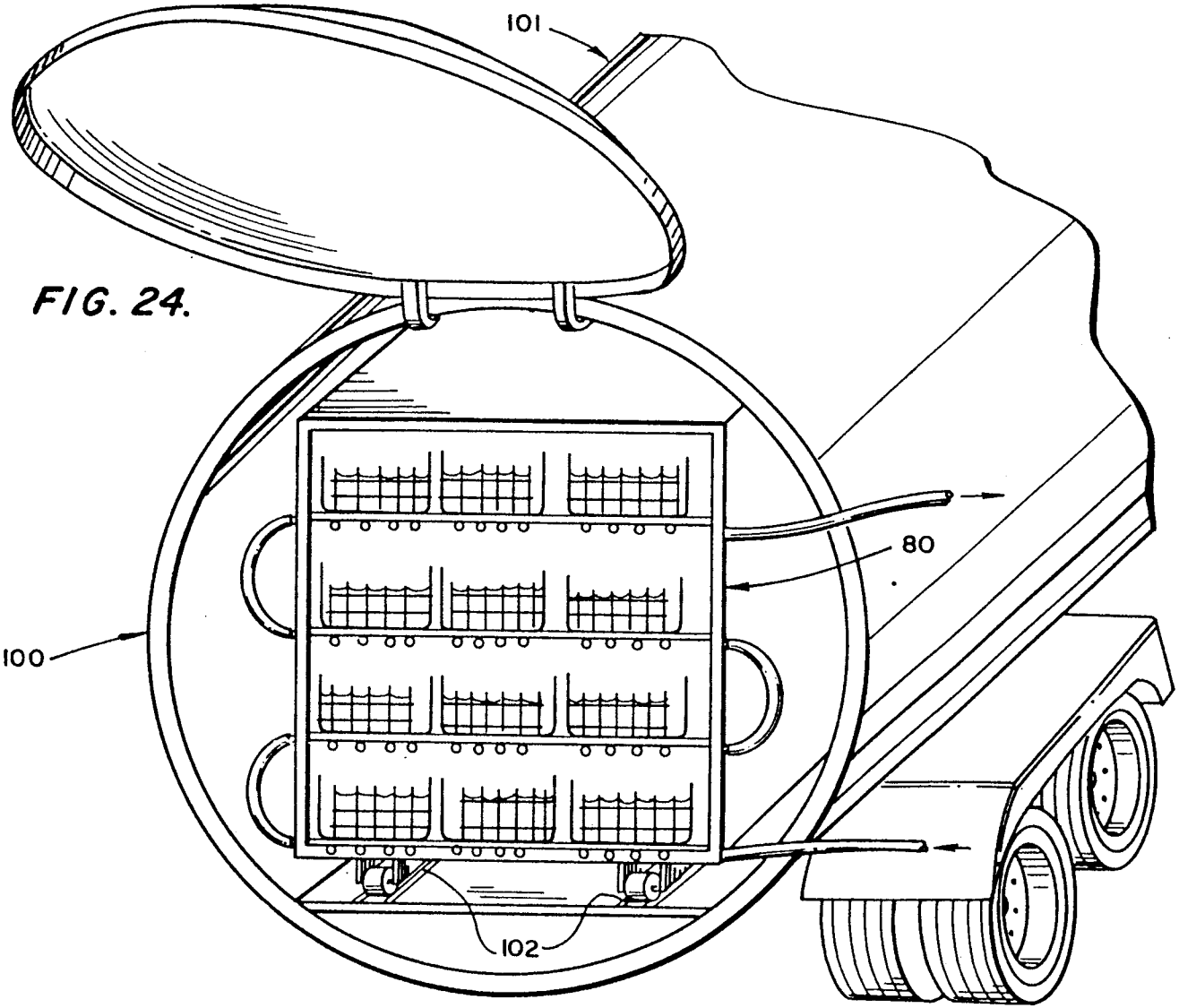

Yet another variation of the invention is shown at 100 in FIG. 24. In this form of the invention a mobile vacuum chamber 101 is provided in a truck T or other movable structure. Carts 80 containing trays of books 11 or other materials and separator plates are placed in the vacuum chamber and may rest on tracks 102 to facilitate placement of the carts into the chamber and removal therefrom. Power means for producing a vacuum and heated medium may be included on the mobile device.

The invention according to any of the forms described above can be used for drying wet books or other materials in a substantially shorter amount of time than is possible with prior art methods and apparatus. For instance, whereas it takes from 10–15 days to dry thoroughly wetted books in accordance with prior art methods, the present invention requires only 4–8 days. Additionally, the gradual application to the wet materials of a uniform low temperature via conduction, in conjunction with vacuum, results in much less stress on the materials being dried and yields a higher quality of dried materials. The use of compression to the materials through rigid plates during the drying process eliminates the distortion usually produced in books and the like which have become wet. The invention can also be used to recondition books and other materials which exhibit heavy distortion from air drying or drying by other prior art techniques.

In carrying out the invention, best results are obtained when the pressure is maintained above the triple point (freezing) of water, with the maximum temperature of the materials maintained below about 120° F. The books are allowed to reach equilibrium just above the freezing temperature, whereby the book materials anneal and, when supported by the rigid compression plates, return to their original condition.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

We claim:

1. Apparatus for simultaneously drying and reshaping or restoring printed materials which have become wet, comprising:

thermally conductive tray means on which the wet materials are placed to be dried and restored;

heating means for gradually applying thermal energy uniformly over the tray means;

thermally conductive separator plate means for placement in parallel relationship to one another between and in contact with predetermined quantities of said materials to separate and support said materials in discrete bundles, said plate means being in contact with said tray means, whereby thermal energy is conducted from the tray means into the plate means and from both the tray means and the plate means into the wet materials;

means for applying a vacuum to said materials while they are supported on said tray means to facilitate removal of moisture from the materials, the magnitude of said vacuum and the amount of thermal energy produced by the heating means being selected so that the wet materials are heated to an equilibrium temperature above the freezing point of water, resulting in evaporation of the moisture from a liquid phase in the materials, whereby the wet materials become plastic and are capable of being reshaped and restored during the drying process; and means for applying a substantially constant compressive force to the materials during drying thereof to straighten and restore the materials to an undistorted condition.

2. An apparatus as claimed in claim 1, wherein:

thermally conductive shelf means are provided on which said tray means are supported while being subjected to said vacuum.

3. An apparatus as claimed in claim 2, wherein:

said heating means comprises a heating coil or serpentine conduit beneath the shelf means through which a heated fluid is circulated to impart thermal energy to the shelf.

4. An apparatus as claimed in claim 2, wherein:

there are a plurality of shelves supported in spaced relationship to one another on a cart; and said cart has open mesh sides to facilitate evaporation of moisture from the wet materials.

5. An apparatus as claimed in claim 3, wherein:

one of said tray end walls is fixed relative to the bottom and the other is slidably movable along the bottom wall toward the opposite end wall.

6. An apparatus as claimed in claim 2, wherein:

the heating means comprises an electric resistance heating element disposed in operative relationship with the shelf means to heat the shelf means.

7. An apparatus as claimed in claim 4, wherein: the vacuum chamber is portable.

8. An apparatus as claimed in claim 7, wherein:

the vacuum chamber is provided on a truck or the like for movement of the chamber from one location to another to provide in situ drying and restoration of wet materials.

9. A method of drying wetted printed materials, comprising the steps of:

supporting the materials on heat conductive means, with the printed material stacked in parallel relationship to one another;

applying thermal energy to the heat conductive means and thus to the wetted materials to heat the moisture therein to promote vaporization thereof, while at the same time subjecting the materials to a vacuum to reduce the magnitude of temperature required to cause the moisture to vaporize; and maintaining the vacuum pressure above the triple point of water, while maintaining the temperature in the materials below about 120° F.

10. A method of restoring printed materials which have become distorted by being wet, comprising the steps of:

arranging the sheets of paper in parallel, stacked relationship to one another;

applying thermal energy to the sheets of paper to heat the sheets of paper to an elevated temperature to promote vaporization of the moisture therein, while subjecting the sheets of paper to a vacuum to promote vaporization of the moisture at a lower temperature and to conduct moisture away from the sheets of paper; and applying a compressive force to the sheets of paper in a direction perpendicular to the plane of the sheets of paper, while they are being subjected to said heat and vacuum, to straighten the sheets of paper.

11. In an apparatus for drying printed materials which have become wet, wherein the apparatus includes a vacuum chamber in which the materials may be placed and subjected to a vacuum for promoting evaporation of moisture from the materials, the improvement comprising:

heat conductive tray means for supporting a quantity of the materials to be dried;

heat conductive separator plate means for placement in spaced apart relationship between adjacent sections of said materials to be dried for separating the materials into separate and discrete quantities and for conducting heat thereto;

heat conductive shelf means on which said trays are supported for drying materials on the trays;

heating means for gradually applying thermal energy uniformly over the shelf for conduction of the thermal energy through the shelf, trays and plates and into the wet materials to promote evaporation of the moisture from the wet materials, said uniform, low temperature drying producing less stress in the materials than prior art techniques and being selected such that the moisture in the materials passes through a liquid phase during the drying process, resulting in plasticity of the materials; and compression means for application to the wet materials for applying a compressive force thereto during the drying process to straighten and restore the wet materials during the drying process, said compression means comprising one or more elastic cords stretched around the assembled materials, tray and plates.

12. In an apparatus for drying printed materials which have become wet, wherein the apparatus includes a vacuum chamber in which the materials may be placed and subjected to a vacuum for promoting evaporation of moisture from the materials, the improvement comprising:

heat conductive tray means for supporting a quantity of the materials to be dried;

heat conductive separator plate means for placement in spaced apart relationship between adjacent sections of said materials to be dried for separating the materials into separate and discrete quantities and for conducting heat thereto;

heat conductive shelf means on which said trays are supported for drying materials on the trays;

heating means for gradually applying thermal energy uniformly over the shelf for conduction of the thermal energy through the shelf, trays and plates and into the wet materials to promote evaporation of the moisture from the wet materials, said uniform, low temperature drying producing less stress in the materials tan prior art techniques and being selected such that the moisture in the materials passes through a liquid phase during the drying process, resulting in plasticity of the materials; and said shelf means is supported on a movable cart having wheels or similar support means to facilitate transport of the trays from one place to another.

13. In an apparatus for drying printed materials which have become wet, wherein the apparatus includes a vacuum chamber in which the materials may be placed and subjected to a vacuum for promoting evaporation of moisture from the materials, the improvement comprising:

heat conductive tray means for supporting a quantity of the materials to be dried;

heat conductive separator plate means for placement in spaced apart relationship between adjacent sections of said materials to be dried for separating the materials into separate and discrete quantities and for conducting heat thereto;

heat conductive shelf means on which said trays are supported for drying materials on the trays;

heating means for gradually applying thermal energy uniformly over the shelf for conduction of the thermal energy through the shelf, trays and plates and into the wet materials to promote evaporation of the moisture from the wet materials, said uniform, low temperature drying producing less stress in the materials than prior art techniques and being selected such that the moisture in the materials passes through a liquid phase during the drying process, resulting in plasticity of the materials; and said tray means is generally U-shaped, having a bottom wall and opposite end walls, said walls being made of aluminum.

14. Apparatus as claimed in claim 1, wherein:

the means for applying a vacuum comprises a vacuum chamber in which the materials are placed for drying and restoration.

15. Apparatus as claimed in claim 1, wherein:

the materials comprise sheets of paper, said separator plate means being interspersed among the sheets of paper in parallel relationship thereto and dividing the sheets into separate, horizontally stacked groups; and the means for applying a compressive force to the materials is operative to apply a force in a direction perpendicular to the plane of the plates and the sheets of paper.

16. Apparatus as claimed in claim 15, wherein:

the means for applying a compressive force comprises elastic cords stretched around the assembled sheets of paper, separator plate means and tray means.

17. Apparatus as claimed in claim 15, wherein:

the means for applying a compressive force comprises an inflatable bladder engaged against one end of the stacked group of sheets of paper and separator plate means, the other end of the stacked group being restrained against movement by the tray means.

18. Apparatus as claimed in claim 15, wherein:

the means for applying a compressive force comprises a fluid operated piston and cylinder arrangement engaged with opposite ends of the stacked group of sheets of paper and separator plate means.

19. Apparatus as claimed in claim 15, wherein:

the means for applying a compressive force comprises resilient spring means engaged with one end of the stacked group of sheets of paper and separator plate means.

20. A method as claimed in claim 9, wherein:

the temperature is applied via a heated fluid circulated through a heating coil disposed in heat conductive relationship with the heat conductive means.

* * * * *